United States Patent [19]

Konishi et al.

[11] Patent Number: 4,963,844

[45] Date of Patent: Oct. 16, 1990

[54] DIELECTRIC WAVEGUIDE-TYPE FILTER

[75] Inventors: Yoshihiro Konishi, Sagamihara; Kenichi Konno, Machida; Ikuo Awai, Ichikawa; Hideo Hikuma, Ichikawa, all of Japan

[73] Assignee: Uniden Corporation, Ichikawa, Japan

[21] Appl. No.: 406,313

[22] Filed: Sep. 12, 1989

Related U.S. Application Data

[63] Continuation-in-part of Ser. No. 293,665, Jan. 5, 1989, abandoned.

[51] Int. Cl.[5] ..... H01P 1/207; H01P 3/16

[52] U.S. Cl. ..... 333/208; 333/202; 333/209; 333/212

[58] Field of Search ..... 333/202–205, 333/208, 209, 212, 219.1, 227, 230, 235, 248

[56] References Cited

U.S. PATENT DOCUMENTS

| | | | |
|---|---|---|---|
| 3,522,560 | 8/1970 | Hayany | 333/208 |
| 4,607,242 | 8/1986 | Cozzie | 333/208 X |
| 4,691,179 | 9/1987 | Blum et al. | 333/208 X |

FOREIGN PATENT DOCUMENTS

| | | | |
|---|---|---|---|
| 0220603 | 9/1988 | Japan | 333/208 |

*Primary Examiner*—Eugene R. Laroche
*Assistant Examiner*—Seung Ham
*Attorney, Agent, or Firm*—Oblon, Spivak, McClelland, Maier & Neustadt

[57] ABSTRACT

A dielectric waveguide-type filter is fabricated by vapor depositing or coating all but one of the four sides extending in the axial direction of a six-sided dielectric block that is long in its axial direction lying perpendicular to its width and height with a conductive material and either leaving the fourth side surface open or forming it with a conductive pattern depending on whether the filter characteristics to be obtained are high-pass characteristics, band-pass characteristics or band-rejection characteristics, the conductive pattern, if formed, being formed in a configuration and distribution depending on the filter characteristics to be obtained. A pair of electrode patterns for electrical connection with an exterior circuit are provided by patterning of conductive material on the opposite axial end surfaces of the dielectric block or on the open surface at positions near the opposite axial end surfaces.

23 Claims, 17 Drawing Sheets

DIELECTRIC WAVEGUIDE-TYPE FILTER

CROSS REFERENCE TO RELATED APPLICATION

This is a continuation-in-part application of Patent application Ser. No. 293,665 filed Jan. 5, 1989 (now abandoned).

BACKGROUND OF THE INVENTION

1. Field of the Invention

This invention relates to a compact microwave filter filled with a dielectric and more particularly to a dielectric waveguide-type filter which enables high-pass characteristics, bandpass characteristics and band-rejection characteristics to be selectively realized with a simple structure.

2. Prior Art Statement

As a dielectric waveguide-type filter of the aforesaid type there is known the coaxial dielectric filter. As might be expected from the fact that it is generally referred to as a "ceramic filter," the coaxial dielectric filter uses ceramic as its dielectric material and specifically uses a rectangular block of such material. Five surfaces of the dielectric block, namely the four side surfaces and one of the two end surfaces in the axial direction (that is to say all of the surfaces except one end surface), are coated by vapor deposition or direct application with silver, aluminum or some other appropriate electrically conductive material so as to form conductive layers or conductive films on these surfaces.

The axial length of the dielectric block is equal to one-quarter of the wavelength at the frequency at which the filter is to be used, and the interior of the block has a through-hole passing therethrough in the axial direction. The inner wall of the through-hole is also coated with a dielectric material in the aforesaid manner. As a result, the coaxial dielectric filter constitutes a coaxial dielectric path having a center conductor which measures one-quarter wavelength and is open at one end and shorted at the other. It thus operates as an LC resonator.

The coaxial dielectric filter of this type is troublesome to fabricate because it requires formation of the axial hole through the interior of the dielectric block and, moreover, requires the center conductor to be completed by applying a dielectric material to the inner wall of this through-hole. Another problem is that it is extremely difficult to fine-adjust the characteristics of the completed filter by, for instance, trimming the center conductor. Further, where it is desired to construct a multi-stage filter circuit by cascade-connecting a plurality of such coaxial dielectric filters, the interconnection of the stages has to be carried out by using capacitors to connect the open surfaces of the center conductors of each adjacent pair of coaxial dielectric filters. The connection of the capacitors to the individual filters not only is troublesome work which reduces productivity but is also undesirable from the point of obtaining uniform characteristics. Actual application of this method has often been found to result in characteristics that leave much to be desired and, moreover, since the propagation loss tends to become large, it has been difficult to realize a high Q factor. Worst of all, there has been no simple way to select the filter characteristics to be obtained. Specifically, it has not been possible by simple modifications in the course of fabrication to obtain the desired high-pass characteristics, bandpass characteristics, band-rejection characteristics or the like.

Further examples of conventional dielectric waveguide-type filters are disclosed, for instance, in U.S. Pat. No. 4,691,179 issued to Stephen C. Blum et al. on Sept. 1, 1987 and in U.S. Pat. No. 4,607,242 issued to James C. Cozzie on Aug. 19, 1986. However, the disclosures do not provide techniques for substantially achieving a satisfactory degree of size reduction and the filters disclosed all require complex structures and complicated procedures for adjustment of the characteristics.

OBJECT AND SUMMARY OF THE INVENTION

One object of this invention is to provide a dielectric waveguide-type filter which overcomes the aforesaid shortcomings of the conventional filters of this type and which can, by means of a simple structure and an exceedingly simple method of fabrication, be realized as a microwave filter that exhibits freely selectable high-pass characteristics, band-pass characteristics and band-rejection characteristics, exhibits small transmission loss and other outstanding characteristics, and can be realized in a very compact size.

For attaining this object, the present invention provides a dielectric waveguide-type filter of a basic structure comprising a dielectric block that is long in an axial direction lying perpendicular to its width and height, conductive layers provided by vapor deposition or coating over all or most of the area of three of four surfaces extending in the lengthwise direction of said dielectric block, the fourth surface being left as an open surface, and a pair of electrode patterns formed by patterning of conductive material on opposite end surfaces of said dielectric block in the axial direction thereof or on regions of said open surface in the vicinity of the opposite ends thereof, said open surface being left as it is or being formed with a conductive pattern depending on whether the filter characteristics to be obtained are high-pass characteristics, band-pass characteristics or band-rejection characteristics, the conductive pattern, if formed, being formed in a configuration and distribution depending on the filter characteristics to be obtained.

It thus becomes possible to obtain the desired filter characteristics by the extremely simple expedient of either applying conductive material on the open surface by vapor deposition or coating or not doing so, and in the case of doing so, applying the conductive material in a pattern appropriate for obtaining the desired characteristics. It furthermore becomes possible to obtain a compact dielectric waveguide-type filter that exhibits low propagation loss.

The surfaces at the axial ends of the dielectric block can be vapor deposited or coated with conductive layers that are electrically connected with the conductive layers applied to the aforesaid three surfaces or, alternatively, they can be left as open surfaces. In some cases the provision of the short surfaces by application of the conductive layers will cause a change in the characteristics obtained while in other cases it will not. This fact can be used for adjustment of the characteristics.

Further, in accordance with the present invention, desired filter characteristics can be obtained or adjusted by making geometric modifications in the exterior configuration of the dielectric block. Such geometric modifications include, for example, providing a step in one of the side surfaces lying perpendicular to the open surface or providing a recess or recesses for reducing the width of the waveguide in the side surface lying parallel to the open surface, the side surfaces lying perpendicular to the open surface or in the open surface itself. Further, the characteristics can be adjusted by removing a part of the conductive layers formed on the side surfaces other than the open surface.

Where such geometric and/or mechanical modifications are to be made in the dielectric block itself, they are, in accordance with this invention, made not at the interior of the dielectric block but at its easily accessible outer surfaces. This means that even after the dielectric waveguide-type filter has once been fabricated, it can be easily and reliably subjected to subsequent mechanical processing for the purpose of, for example, removing a portion of the dielectric block or one of the conductive layers.

The above and other features of the present invention will become apparent from the following description made with reference to the drawings.

DETAILED DESCRIPTION OF THE PREFERRED EMBODIMENTS

Figure 1:
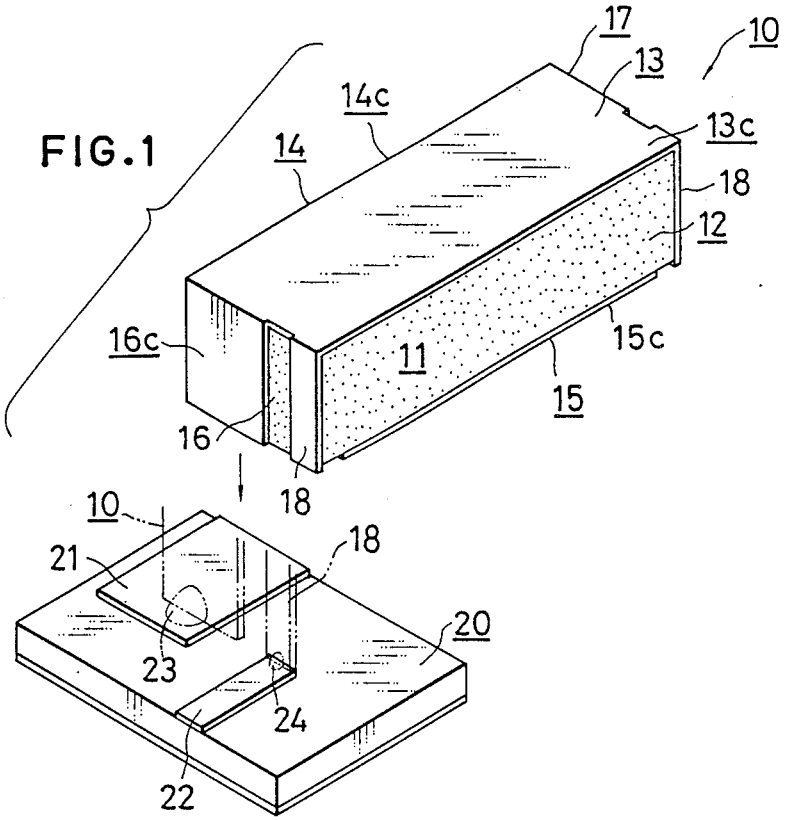
FIG. 1 is a perspective view of an embodiment of a dielectric waveguide-type filter according to the present invention, which is constituted as a high-pass filter.

FIG. 1 shows a perspective view of an embodiment of a dielectric waveguide-type filter according to the present invention constituted as a high-pass filter.

This filter, designated by reference numeral 10, comprises a rectangular dielectric block 11 which should preferably have as high a relative dielectric constant $\epsilon_r$ as possible. Ceramic materials with a relative dielectric constant $\epsilon_r$ of around 90 are in fact readily available. As was mentioned earlier, dielectric waveguide-type filters of this type have come to be known simply as ceramic filters from the fact that ceramic materials are invariably used for the dielectric blocks thereof. While the dielectric block 11 in the present invention can of course also be constituted of a ceramic, it is not limited to the use of a ceramic and may alternatively be formed of any material with a high relative dielectric constant.

The dielectric block 11 is a rectangular parallelepiped that considerably longer than it is wide and high. It is thus a hexahedron and naturally has six sides. For convenience of explanation, the four surfaces extending in the lengthwise (axial) direction will be referred to as the side surfaces 12, 13, 14, 15 in this specification, while the surfaces at the opposite ends in the axial direction will be referred to as the end surfaces 16, 17 or the axial end surfaces 16, 17. Further, among these four side surfaces 12, 13, 14, 15, the surface 13, which faces upward in the drawing, and the surface 15, which lies parallel to the surface 13 but is hidden in the drawing, will, as required, be referred to as the upper surface 13 and the bottom surface 15, respectively.

Among the four side surfaces 12, 13, 14, 15 of the dielectric block 11, all but one side surface 12, namely the three remaining side surfaces 13, 14, 15, are vacuum deposited or coated over their entire areas with an appropriate metallic material or conductive material such as silver or aluminum. When convenient, the side surface 12 which is not coated with conductive material will be referred to as the "open surface," while the side surface 14 lying parallel thereto will be referred to as the "rear surface." Moreover, the conductive layers or conductive films formed by application of conductive material to the side surfaces 13, 14, 15 in the aforesaid manner will be denoted by addition of a suffix c so that, for example, the conductive layer on the side surface 13 will be designated by the symbol 13*c*.

In the case of the present embodiment, the end surfaces 16, 17 are formed with end surface conductive layers 16*c*, 17*c* at all but one portion thereof and at the same time, as will be explained in detail later, are formed separately from the end surface layers 16*c*, 17*c* with conductive patterns 18, 18 constituting excitation electrodes for the present high-pass filter. The conductive patterns or excitation electrodes 18, 18 are formed as narrow patterns extending in the heightwise direction from the upper surface 13 toward the side of the bottom surface 15 but only the upper end thereof is electrically connected with the conductive layer 13*c* while the side edges and lower end thereof do not make contact with any of the conductive layers. In other words, for satisfying the aforesaid relationship, gaps of appropriate magnitude are provided between the respective conductive layers 16*c*, 17*c* on the end surfaces 16, 17 and the excitation electrodes 18, 18 so as to avoid contact therebetween. Further, as is clear from the essential portion illustrated in FIG. 2, a prescribed small area portion of the bottom surface conductive layer 15*c* is removed in the vicinity of each of the excitation electrodes 18, 18 (i.e. the conductive layer 15*c* is patterned so as not to be formed in this small area portion).

One of the two excitation electrodes is of course used as an input terminal for electromagnetic wave signals while the other is used as an output terminal.

As described in the foregoing, the static structure is exceedingly simple. The high-pass filter of FIGS. 1 and 2 can be fabricated with utmost ease, the excitation electrodes 18, 18 included, simply by forming conductive layers on the surfaces of the dielectric block 11 in prescribed configuration patterns. Nor does the dielectric block 11 require any complex processing; substantially it need only be formed as a rod with a rectangular cross section.

Moreover, where the high-pass filter 10 according to this invention is to be mounted on a substrate and used as one component of an electrical circuit, this can be simply achieved by, for example, the method also illustrated in FIG. 1.

More specifically, as shown in phantom lines, the high-pass filter 10 is mounted on a substrate 20 which is formed with a conductive pattern 21 for making electrical contact with the bottom surface conductive layer 15*c* and with microstrips 22, 22 (only one illustrated in the drawing) for making contact with the excitation electrodes 18, 18 at the aforesaid free ends thereof (corresponding to the lower end in the drawing). Therefore, by providing the solder joints 23, 24 shown by phantom lines, it becomes possible to provide physical supporting force and also to provide electrical connection to an unshown external circuit via the ground conductor 21 and the microstrips 22. Means such as these can also be similarly used in the other embodiments described hereinafter.

Figure 2:
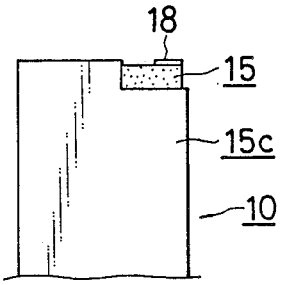
FIG. 2 is schematic view from below of the vicinity of one axial end of the first embodiment.

In FIGS. 1 and 2, although the conductive layers are shown as having considerable thickness so as to make them clearly visible, since as explained above they are in fact formed by vapor deposition or coating, they normally have thicknesses more on the micron order than on the sub-millimeter order. In the drawings relating to the embodiments to be described hereinafter, the thickness of the conductive layers are in some cases similarly illustrated in an exaggerated manner, while in some other drawings, such as those in which the dimensional relationships and the like are shown, their thickness dimension is omitted. Further, although the drawings show the conductive layers as having shiny metallic surfaces, they may instead have rough, light-scattering surfaces, particularly in the case where they are formed by vapor deposition.

The reason why the filter 10 according to the present invention illustrated in FIGS. 1 and 2 operates as a high-pass filter can be explained as follows.

Figure 3:
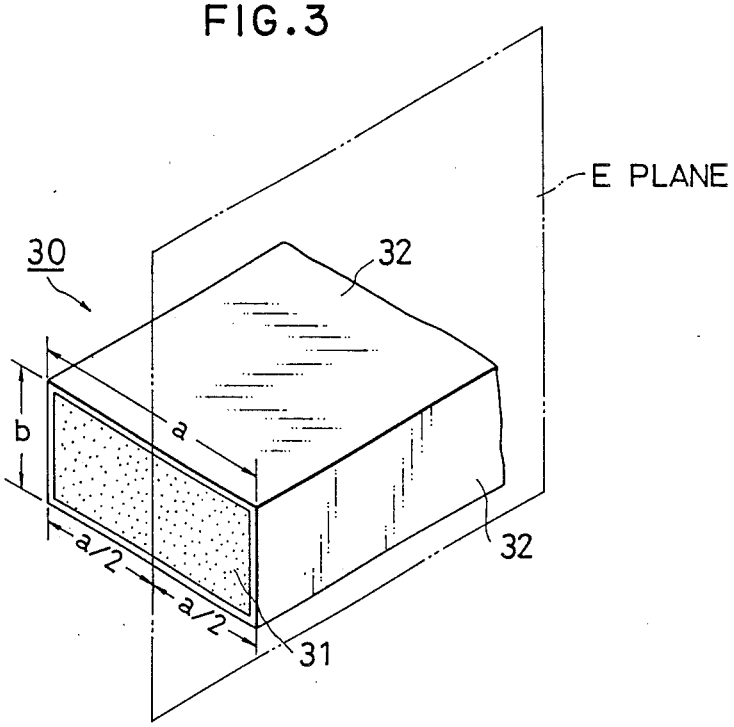
FIG. 3 is a perspective view of the essential portion of a known dielectric rectangular waveguide.

FIG. 3 schematically illustrates the portion of a known dielectric rectangular waveguide 30 extending from one end thereof to an intermediate portion in its axial direction. As is well known, this type of dielectric rectangular waveguide 30 consists of a ceramic block 31 of a relative dielectric constant $\epsilon_r$ which has conductive layers 32 formed on all four of its side surfaces by the vapor deposition or coating of a metal. As illustrated, it generally has a width a selected to be about twice its height b.

As a matter of principle, however, the height b can be selected with a considerable degree of freedom and the propagation characteristics of a waveguide 30 of this type are greatly affected by the width which lies parallel to the H plane of the electromagnetic waves propagating through the guide and perpendicular to the E plane thereof. For example, where the cut-off frequency is $f_c$ and the cut-off wavelength is $\lambda_c$, the following equation holds:

$$\lambda_c = C_o/f_c = 2a\sqrt{\epsilon_r} \tag{1}$$

where $C_o$ is, of course, the speed of light in a vacuum. Thus in this way, the prior art dielectric rectangular waveguide 30 of FIG. 3 operates as a kind of high-pass filter and the wavelength $\lambda_g$ within the guide at the frequency f of a propagating electromagnetic wave of higher frequency than the cut-off frequency $f_c$ can be represented as follows:

$$\lambda_g = C_o/(\sqrt{\epsilon_r}\ \sqrt{f^2 - f_c^2}) = \lambda_o \cdot \lambda_c/(\sqrt{\epsilon_r}\ \sqrt{\lambda_c^2 - \lambda_o^2}) \tag{2}$$

Figure 4:
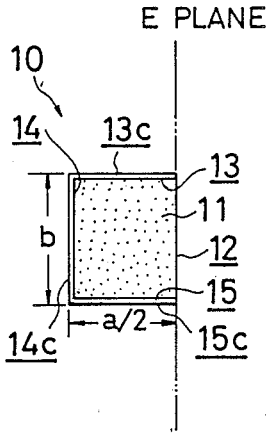
FIG. 4 is a sectional view of the embodiment of FIG. 1 for explaining the principle of the present invention in relation to the prior art waveguide of FIG. 3.

Thus in the present invention the basic structure is, as shown in FIG. 4, what is obtained when the prior art dielectric rectangular waveguide 30 is bisected into two lateral halves by the E plane through the center axis of its waveguide as illustrated by the phantom lines in FIG. 3.

Regarding this type of microwave transmission technology, in theoretical terms this amounts to an ingenious utilization of the known mirror effect. In a case where a electromagnetic wave is propagating through the interior of the waveguide, the distribution of its magnetic field is perpendicular and symmetrical with respect to the E plane passing trough the center axis of the waveguide. Thus, even if the waveguide is bisected along the E plane and only one of the two halves is used, both of the aforesaid equations (1) and (2) still hold. In other words, where the same cut-off frequency $f_c$ and cutoff wavelength $\lambda_c$ are to be obtained, the present invention makes it possible to reduce the width a to at least one-half (a/2) as compared with the prior art dielectric rectangular waveguide 30 shown in FIG. 3, and thus provides a high-pass filter that is much more compact.

If to the contrary the dimension a/2 in the structure of FIG. 4 should be made the same as the width of the dielectric rectangular waveguide 30 shown in FIG. 3 and having the conductive layers 32 on all side surfaces thereof, then of course this would be the same as bisecting a known waveguide having a substantial width of *2a* along the E plane passing along the center axis thereof, so that, as is clear from the result of replacing a with *2a* in Equation (1), the cut-off frequency $f_c$ would be halved and the cut-off wavelength $\lambda_c$ would be doubled.

In the present invention, it was the fact that the ceramic block 31 of high relative dielectric constant had come into use that led to the idea of obtaining the basic high-pass filter 10 shown in FIG. 1 by employing the mirror effect in respect of the prior art dielectric rectangular waveguide 30.

Prior to the advent of the dielectric rectangular waveguide 30 of the aforesaid type, there was available a well-known hollow waveguide. However, if such a waveguide should be bisected along the E plane passing along the center axis thereof, the electromagnetic waves would radiate out from the side laid open by the bisection so that the result could in no way be expected to function as a high-pass filter. In contrast, by using the dielectric block to obtain an arrangement that corresponds to a hollow waveguide with its cavity filled with a dielectric material having a high relative dielectric constant, then in accordance with this invention, even if the structure is what is obtained by bisecting the prior art structure of FIG. 3 into two lateral halves, the electromagnetic waves will be captured by the dielectric material without radiation thereof to the exterior. (Strictly speaking, there will by a slight radiated component but it is negligible in practical applications.)

For the reasons set out in the foregoing, the first embodiment of the present invention explained with reference to FIGS. 1, 2 and 4 is of a compact and easy-to-fabricate structure and thus is able to function satisfactorily as a high-pass filter 10 of cut-off frequency $f_c$.

As a specific numerical example consider the case where the width a/2 is 6.3 mm and the relative dielectric constant $\epsilon_r$ is 90. Substituting these values into Equation 1 and solving for cut-off frequency $f_c$, shows that there is obtained a high-pass filter with a cut-off frequency $f_c$ of about 1.25 GHz. For confirming this, a dielectric waveguide-type filter 10 was fabricated in the dimensions shown in FIG. 5A and the characteristics thereof were found to be as shown in FIG. 5B.

Figure 5A:
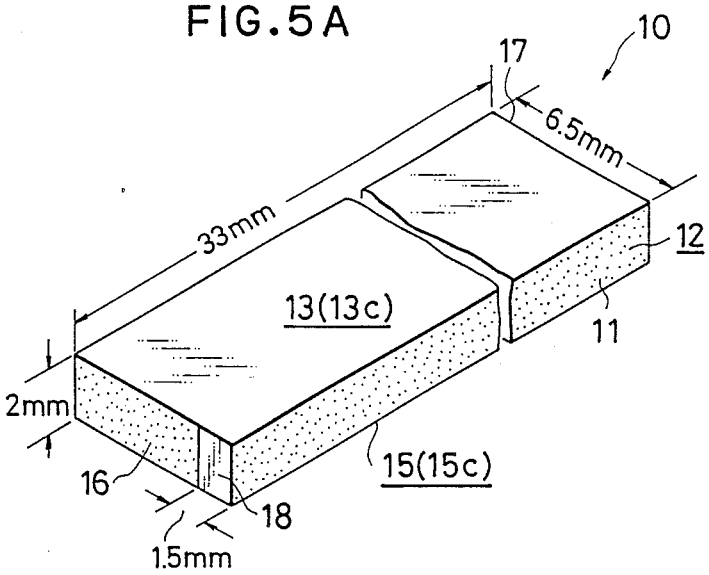
FIG. 5A is a perspective view of an example of the embodiment shown in FIG. 1 constituted to the specific dimensions indicated.
Figure 5B:
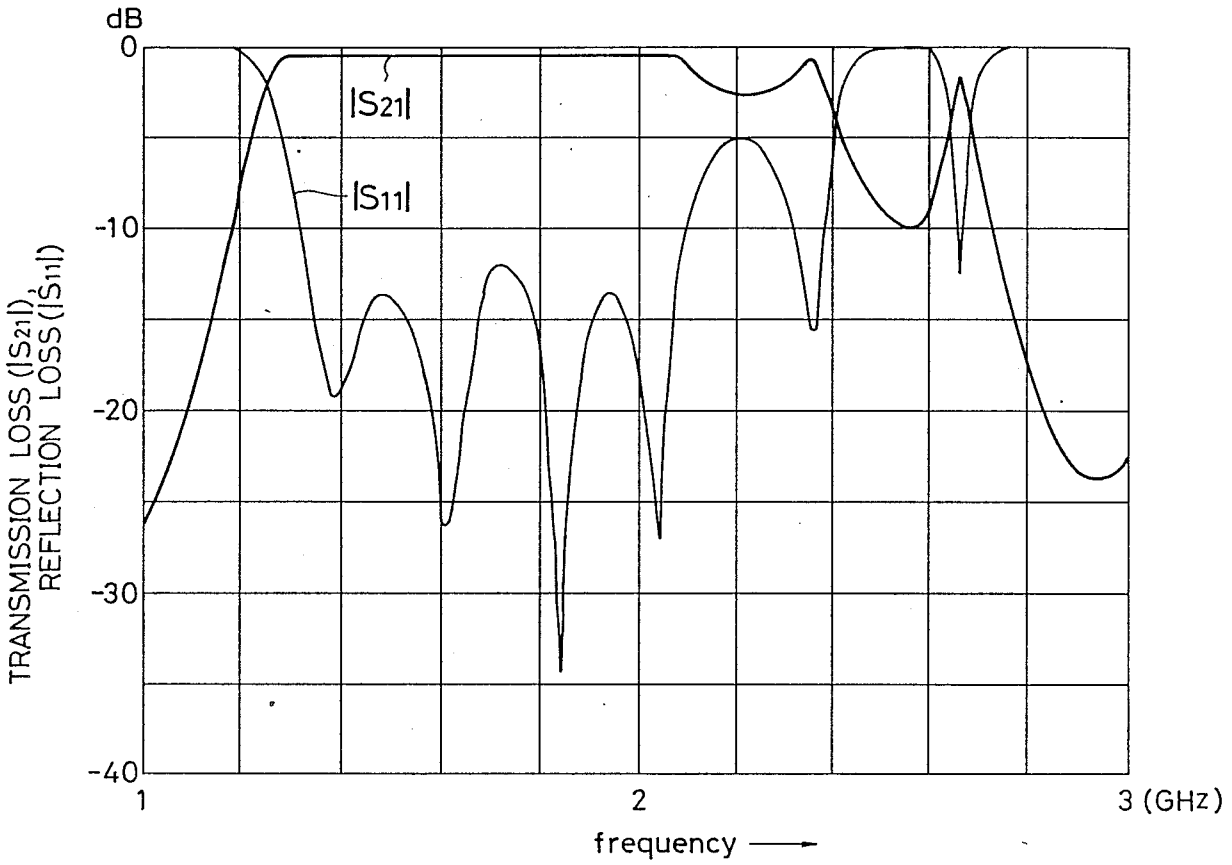
FIG. 5B is a graph showing the high-pass characteristics of the embodiment of FIG. 5A.

While the embodiment illustrated in FIG. 5A is in principle identical to the embodiment shown in FIGS. 1 and 2, it differs therefrom in that it is not provided with the conductive layers 16*c*, 17*c* on the opposite end surfaces 16, 17. Instead, the end surfaces 16, 17 are in principle left open and these open surfaces are pattern formed only with excitation electrodes 18, 18 for making electrical connection with microstrips 22, 22 similar to those formed on the substrate 20 of FIG. 1. It should be pointed out beforehand that in the filter according to the present invention, and particularly in the case of fabricating the high-pass filter 10, the electrical characteristics of the filter do not differ greatly between the case where the end surface conductive layers 16c, 17c are provided and the case where they are not, namely between the case where the end surfaces 16, 17 are short surfaces and the case where they are open surfaces. This is because the excitation electrodes 18, 18 provide excitation directly to the waveguide from the end surfaces. For the reason explained earlier, the thickness dimension of the conductive layers is not shown in the figures.

At any rate, as is clear from FIG. 5, the dielectric waveguide-type filter 10 of FIG. 5A fabricated to specific dimensions in accordance with the first embodiment of this invention functions adequately as a high-pass filter permitting low-loss transmission of electromagnetic wave signals within a certain band of frequencies above the cut-off frequency. However, it measures 6.5 mm in width, slightly wider than the 6.3 mm used in the earlier example calculation, so its cut-off frequency $f_c$ is accordingly somewhat lower than the 1.25 GHz obtained in the example calculation. The relative dielectric constant of the dielectric block 11 used was 90 and this is the value that will also be used in all subsequent embodiments in which concrete characteristics are referred to. Also, according to common practice in this field, in the characteristic graph the symbol $|S_{21}|$ indicates the transmission loss and the symbol $|S_{11}|$ indicates the reflection loss and, as is conventional, each is calibrated in decibels in terms of the power ratio.

On the other hand, as has been explained in the foregoing, the present invention provides a structural miniaturization of the prior art dielectric rectangular waveguide 30 shown in FIG. 3 without causing any change in the characteristics. Considering this, it is, as regards the excitation means itself of the filter according to the present invention, possible to appropriately modify and employ in the present invention any of the means which have been used with the prior art dielectric rectangular waveguide 30 or the even earlier hollow waveguide.

Figure 6:
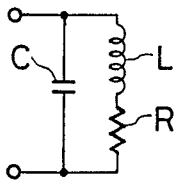
FIG. 6 is an equivalent circuit of the input section obtained by an electrode pattern applied in the manner shown in FIGS. 1 and 2.

For example, the excitation electrodes 18, 18 referred to in the explanation up to this point are constituted as conductive patterns provided on the opposite end surfaces of the dielectric waveguide-type filter 10. The excitation electrodes 18, 18 of this type are indeed preferable since as shown in the equivalent input circuit in FIG. 6 the relationship is such that a capacitance C is connected in parallel with an inductance L and a resistance R, whereby the input impedance, which tends to be low in the ordinary waveguide structure, can be raised to a higher value. Moreover, the coupling at the conversion section between the strips connected with these electrodes and the filter of the present invention can be obtained with wide band width and low loss.

Figure 7A:
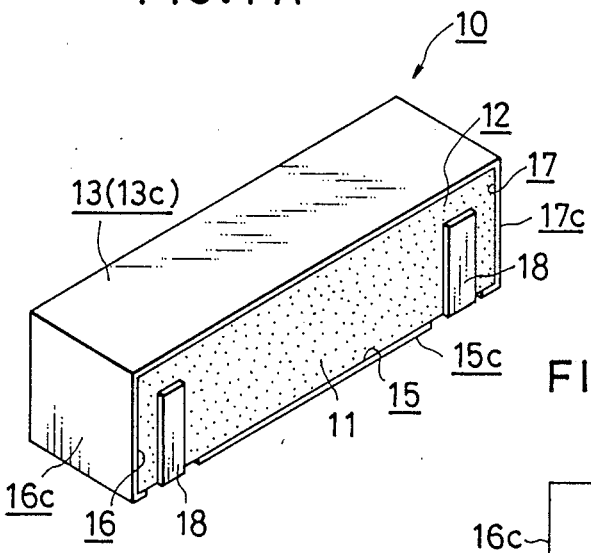
FIG. 7A is perspective view of an embodiment in which the electrode pattern is configured and applied differently from the case of FIGS. 1 and 2.
Figure 7B:
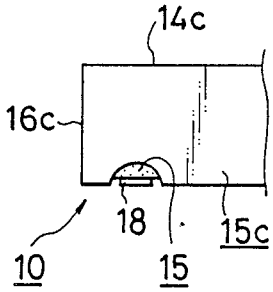
FIG. 7B is a bottom view of the essential part of the electrode pattern attachment region in the embodiment of FIG. 7A.

However, it is alternatively possible to use a structure in accordance with the conventional excitation technique based on the coaxial line-waveguide conversion principle, and to attach patterned excitation electrodes 18, 18 as shown in FIGS. 7A and 7B. More specifically, to use an arrangement in which narrow excitation electrode patterns 18, 18 are patterned onto portions of the exposed (open) surface 12 of the dielectric block 11 in the vicinity of the opposite axial ends thereof so as to extend in the direction of height without making electrical contact with any conductive layer portion at either the top or bottom ends thereof, and in which the bottom surface conductive layer 15c is provided in the vicinity of the portions where the excitation electrode patterns 18, 18 are present with small area portions formed by removing the conductive material in a semicircular form.

Electrical contact with such excitation electrodes 18, 18 formed by conductive patterns 18, 18 can of course be obtained by solder connection to microstrips formed on a substrate, by a method similar to that shown in FIG. 1. (Provided, however, that the direction in which the microstrips are led out would, for example, be offset by 90° from what is shown in FIG. 1 so as not to come in contact with the ground conductor 21.) This arrangement corresponds to what would be obtained if for coupling an electromagnetic wave propagated along a coaxial line with the classical hollow waveguide, the core conductor of the coaxial cable should be led vertically into the waveguide along the E plane without coming into contact with the wall of the hollow waveguide, and is realized by forming the core conductor as the narrow, plate-like conductor patterns 18, 18. As explained earlier, the dielectric waveguide-type filter 10 according to this invention corresponds to what would be obtained by filling the cavity of such a hollow waveguide with a dielectric and then bisecting it in the axial direction into two lateral halves. Therefore, it can be considered that excitation electrode patterns 18, 18 configured and disposed as illustrated in the figure correspond to what would be obtained by also bisecting and then flattening the core conductor of the coaxial line. From this it will be understood that other structures can be used for the excitation electrodes 18, 18 and other techniques can be employed for the attachment thereof. For example, as can be seen from the embodiment illustrated in FIG. 18, it is possible to use a structure in which connection with an external circuit is obtained in the axial direction.

Figure 8A:
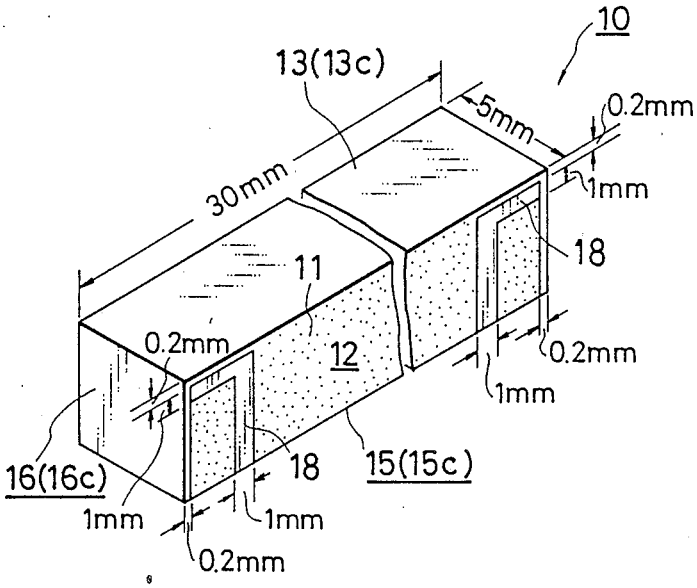
FIG. 8A is a perspective view of another embodiment of the invention constituted as a high-pass filter and shown together with specific dimensions.
Figure 8B:
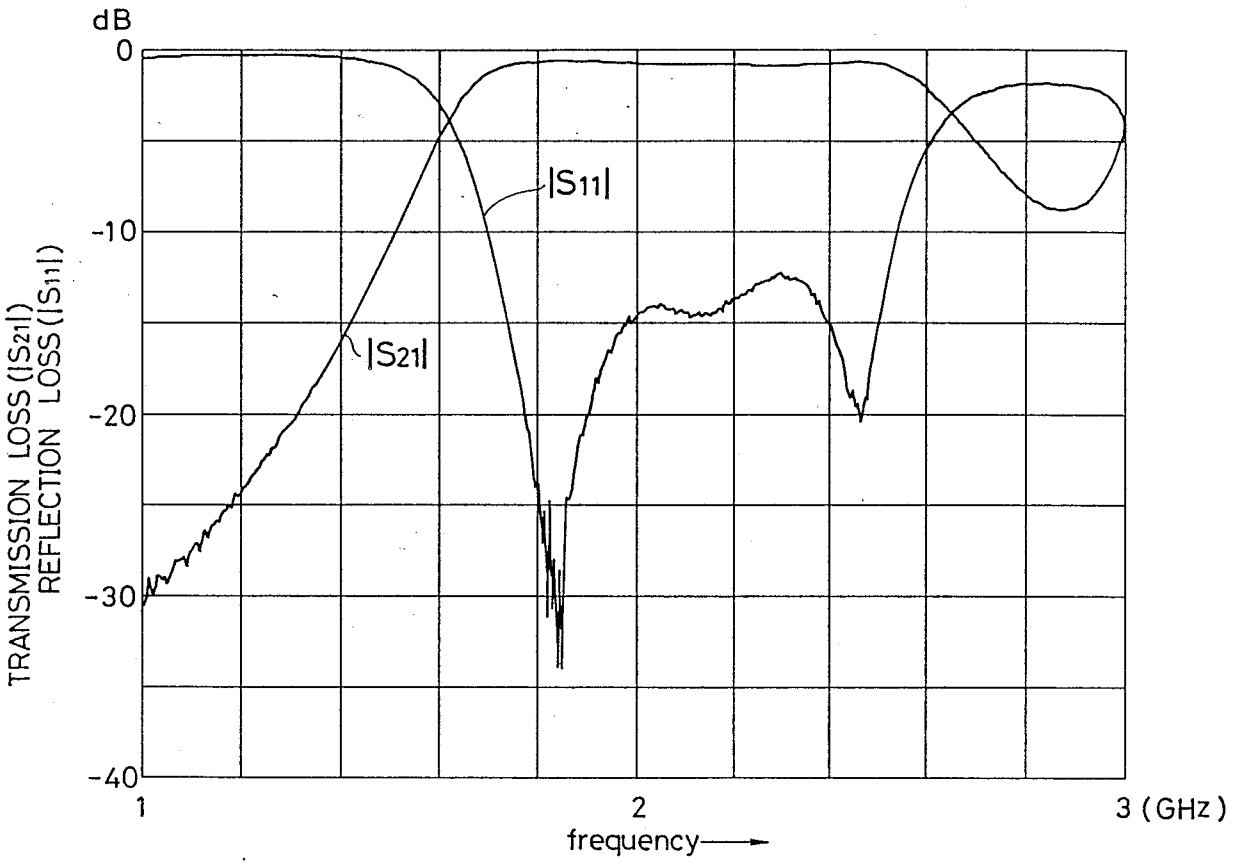
FIG. 8B is a graph showing the high-pass characteristics of the embodiment of FIG. 8A.

Generally speaking, however, use of excitation electrodes 18, 18 of the type illustrated in FIGS. 7A and 7B is advantageous in the case of using a dielectric block 11 of relatively great height (wherein the aforesaid dimension b is large). This is because there are numerous cases in which the excitation electrodes 18, 18 have to be fairly long in the height direction in order to obtain adequate wide-band, low-loss coupling at the coaxial line-waveguide conversion section. If the excitation electrodes 18, 18 are formed into inverted L's by being bent approximately at right angles at an intermediate portion thereof, as shown in FIG. 8A, their effective length can of course be made as long as required even though the height b is small. When a high-pass filter according to the invention was actually fabricated in accordance with the dimensions shown in FIG. 8A, its characteristics were as shown in FIG. 8B. Compared with the characteristics shown in FIG. 5B, the characteristics of FIG. 8B are less jagged on the high frequency side.

Figure 9A:
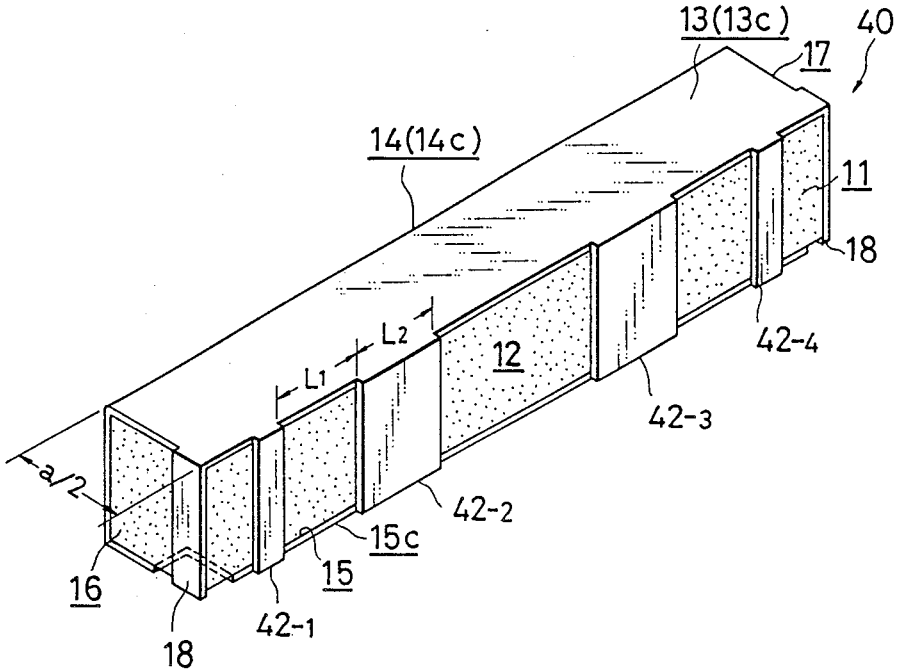
FIG. 9A is a perspective view of a dielectric waveguide-type filter according to the present invention constituted as a band-pass filter.

.FIG. 9A shows a bandpass filter 40 in accordance with one embodiment of this invention. In the drawing, the symbols which are the same as those used up to now designate the same or corresponding elements.

This embodiment also has a dielectric block 11 which preferably has as high a relative dielectric constant $\epsilon_r$ as possible and the upper surface 13, rear surface 14 and bottom surface 15 thereof are formed continuously with conductive layers 13c, 14c, 15c by vapor deposition of or coating with silver or other appropriate conductive material. Of the side surfaces, only the one remaining surface 12 is left open.

The end surfaces 16, 17 are also left open in this embodiment, but, similarly to what was explained earlier in respect of FIGS. 1, 2 and 5A, these surfaces are formed with excitation electrodes 18, 18, one of which is used as an input electrode and the other of which is used as an output electrode.

The open surface 12 of the dielectric block 11 is formed with conductive patterns $\mathbf{42}_{-1}$, $\mathbf{42}_{-2}$, $\mathbf{42}_{-3}$, $\mathbf{42}_{-4}$ of prescribed widths disposed at intervals in the axial direction so as each to short the upper conductive layer 13c and the bottom conductive layer 15c. These can of course be readily formed, at the same time as conducting pattern formation of the conductive layers 13c, 14c, 15c and the excitation electrodes 18, 18.

This structure functionally corresponds to the inductive post type bandpass filter used in the conventional hollow waveguide and the conductive patterns $\mathbf{42}_{-1}$, $\mathbf{42}_{-2}$, $\mathbf{42}_{-3}$, $\mathbf{42}_{-4}$ formed on the open surface 12 of the dielectric block 11 each plays the role of one inductive post. However, the operation of the bandpass filter 40 will be better understood from the following explanation.

In FIG. 9A, consider, for example, the first width portion $L_1$ between the first conductive pattern $\mathbf{42}_{-1}$ and the second conductive pattern $\mathbf{42}_{-2}$ and the second width portion $L_2$ of the second conductive pattern $\mathbf{42}_{-2}$. The portion of axial length $L_1$ where the open surface 12 of the dielectric block is exposed becomes a waveguide having one side surface of the dielectric block 11 open, as shown in FIG. 4. Thus if this width is, for example, a/2, then the cut-off frequency $f_{c1}$ at this portion becomes the value of $f_c$ obtained from Equation 1.

However, the portion of length $L_2$ where the conductive pattern $\mathbf{42}_{-2}$ is present is substantially identical in structure to the prior art dielectric rectangular waveguide 30 which, as shown in FIG. 3, is covered on all side surfaces with the conductive layers 32, except that the width, which is a in FIG. 3, is instead a/2 in the embodiment of FIG. 9A. Thus, since the cutoff frequency $f_{c2}$ is what is obtained by substituting a/2 for a in Equation 1, the cut-off frequency $f_{c2}$ is in principle double that of the cut-off frequency $f_{c1}$.

Therefore, while a signal of frequency $f > f_{c1}$ can propagate through the portion $L_1$, a higher frequency signal of frequency $f > f_{c2}$ can only propagate through the portion $L_2$. Thus, a signal of frequency f, where $f_{c1} < f < f_{c2}$, can be freely adjusted as to its amount of attenuation by selection of the length of the portion $L_2$, i.e. of the axial dimension of the conductive pattern $\mathbf{42}_{-2}$.

Figure 9B:
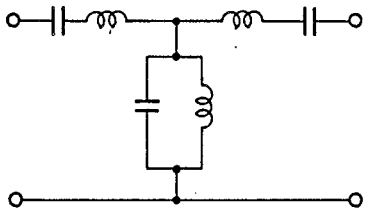
FIG. 9B is an equivalent circuit of the embodiment of FIG. 9A.

As a result, the function performed by the respective inductive posts in the conventional, complexly structured inductive post type bandpass filter is in the present invention performed by the conductive patterns $\mathbf{42}_{-i}$ (i=1, 2, ....) which can be formed on the open surface 12 of the dielectric block 11 by mere patterning. For this reason, the illustrated filter 40 is able to function as a bandpass filter in the desired manner and, in particular, where the open surface 12 of the dielectric block 11 is provided with the four illustrated conductive patterns $\mathbf{42}_{-1}$, $\mathbf{42}_{-2}$, $\mathbf{42}_{-3}$, $\mathbf{42}_{-4}$, there is obtained a three-stage bandpass filter whose equivalent circuit consists of a series resonant circuit, a parallel resonant circuit and a series resonant circuit, as shown in FIG. 9B. The portions between the excitation electrodes 18, 18 and the nearest of the conductive patterns $42_{-1}$ and $42_{-4}$ constitute conversion sections for propagation of the signal to the waveguide.

Figure 10A:
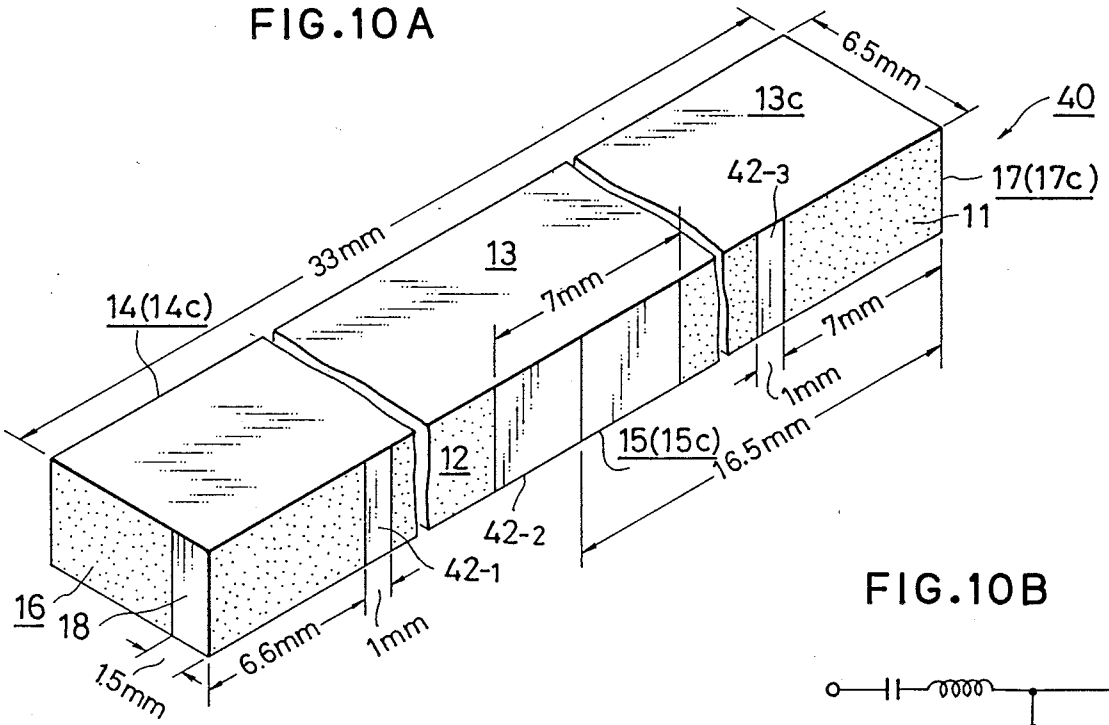
FIG. 10A is perspective view of another embodiment of the invention constituted as a band-pass filter and shown together with specific dimensions.

It is also possible to design a bandpass filter of good practical performance which has a number of cascaded stages, such as the two-stage bandpass filter illustrated in FIG. 10A, though the number of stages is of course not limited to two. This figure includes the dimensions of an actual filter fabricated by the inventors and the thickness of the conductive layers is therefore not shown. Three conductive patterns ($42_{-1}$, $42_{-2}$, $42_{-3}$) each corresponding to an inductive post are formed on the open surface 12 of the dielectric block 11.

Figure 10B:
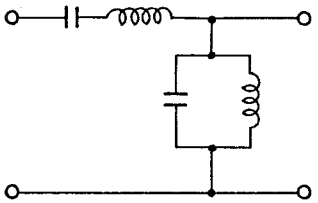
FIG. 10B is an equivalent circuit of the embodiment of FIG. 10A.
Figure 10C:
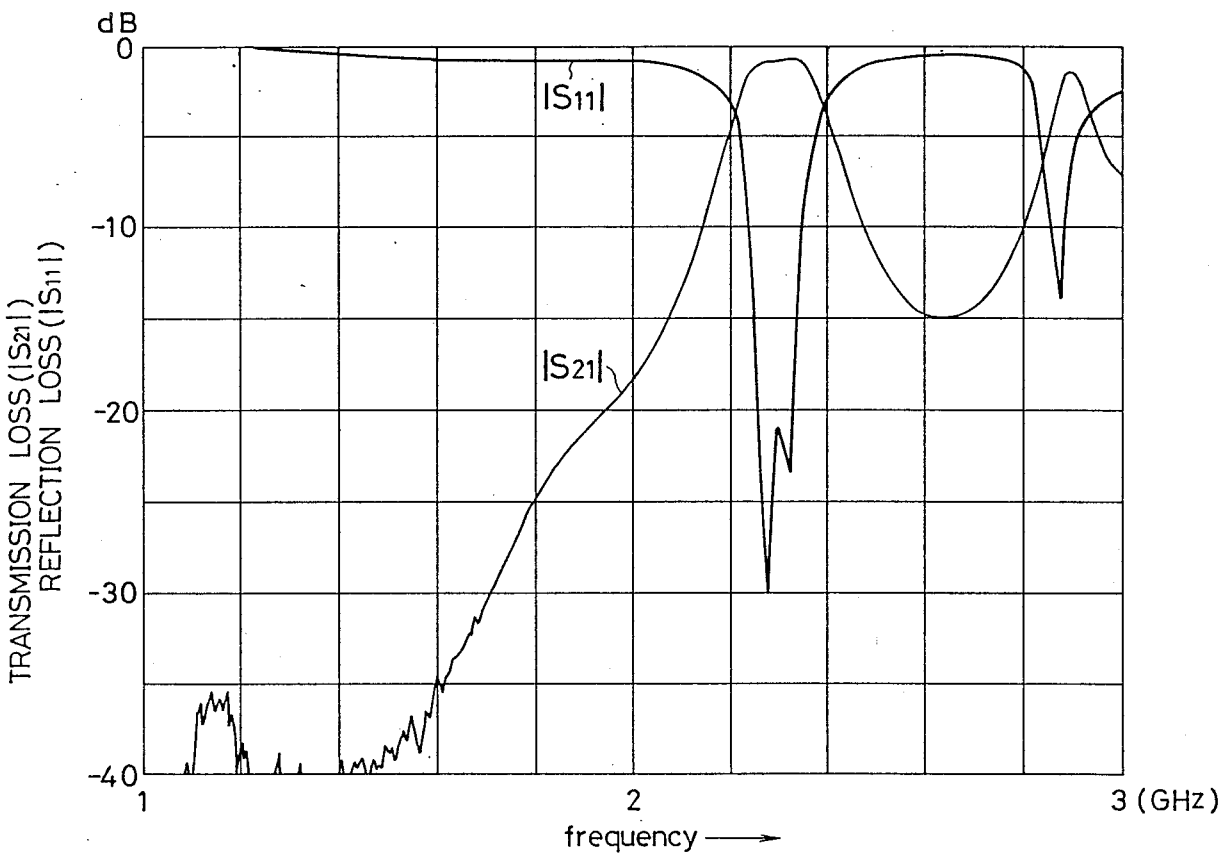
FIG. 10C is a graph showing the band-pass characteristics of the embodiment of FIG. 10A.

The equivalent circuit of the bandpass filter 40 according to the embodiment of FIG. 10A is as shown in FIG. 10B and consists of a combination of one series resonant circuit and one parallel resonant circuit. The characteristics actually obtained are as shown in FIG. 10C and are clearly bandpass characteristics.

Figure 11:
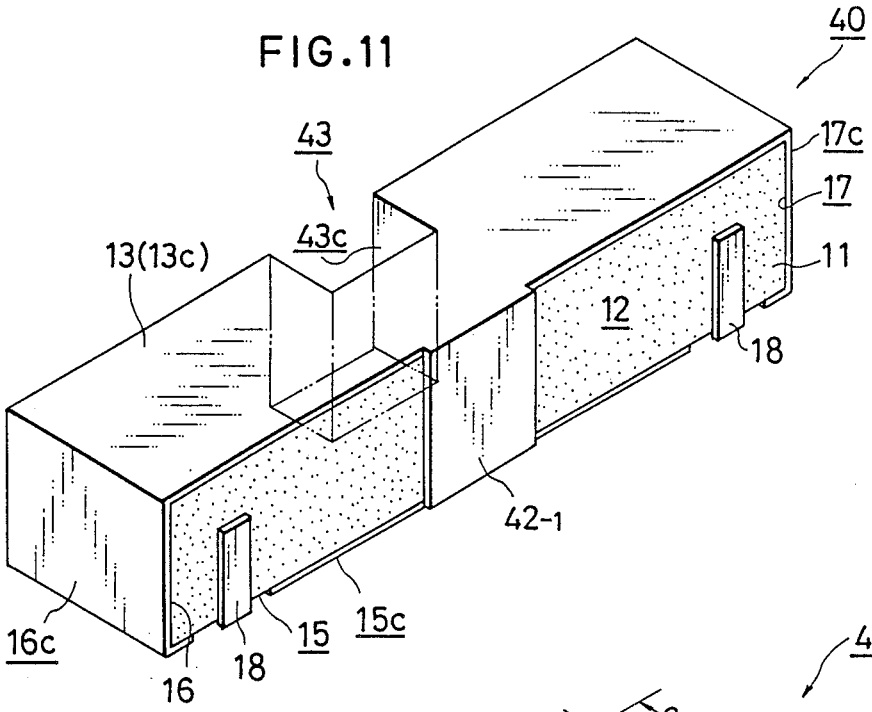
FIG. 11 is a perspective view of an embodiment of the invention in which a recess is provided in the side surface parallel to the open surface.

The present invention thus enables very easy fabrication of a bandpass filter exhibiting desired characteristics simply by controlling the configuration in which a conductive material is patterned on the open surface 12 of the dielectric block 11, providing immeasurably higher productivity than is possible with the conventional structure used for bandpass filters of this type. Further, since the functional portion includes no parts which require mechanical assembly by the human hand, a high degree of reliability is also obtained. However, the bandpass characteristics shown in FIG. 10C are not necessarily as narrow as might be desired. Where a filter with a narrower band is desired, therefore, the filter can be modified as shown in FIG. 11.

In the illustrated arrangement, a single conductive pattern $42_{-1}$ is formed on the open surface 12 of the dielectric block 11, while the rear surface 14 of the dielectric block 11 is provided at a position opposite the conductive pattern $42_{-a}$ with a recess 43 extending from the upper side to the bottom side. The walls of the recess 43 are provided with a conductive layer 43c by vapor deposition or coating.

In this structure, since the waveguide is narrower at the portion where the recess 43 is present, the degree of coupling between a first resonator extending from one end surface 16 to the open surface conductive pattern $42_{-1}$ and a second resonator extending from the other end surface 17 to the open surface conductive pattern $42_{-1}$ can be reduced and adjusted by selecting the depth of the recess 43, making it possible to obtain a bandpass filter with an extremely narrow bandwidth.

Differently from the embodiment of FIG. 10A but similar to what was explained with reference to the embodiments of FIGS. 7A and 8A, in the embodiment of FIG. 11 the excitation electrodes 18, 18 are formed directly on the open surface 12 of the dielectric block 11 such as to meet the requirements for operation according to the coaxial line-waveguide conversion principle. Therefore, it is possible to obtain a bandpass filter with a total of two stages, one at either end, even though there is only a single conductive pattern $42_{-1}$. What this means is that the excitation electrodes 18, 18 are directly coupled to the first and second resonators.

Figure 12A:
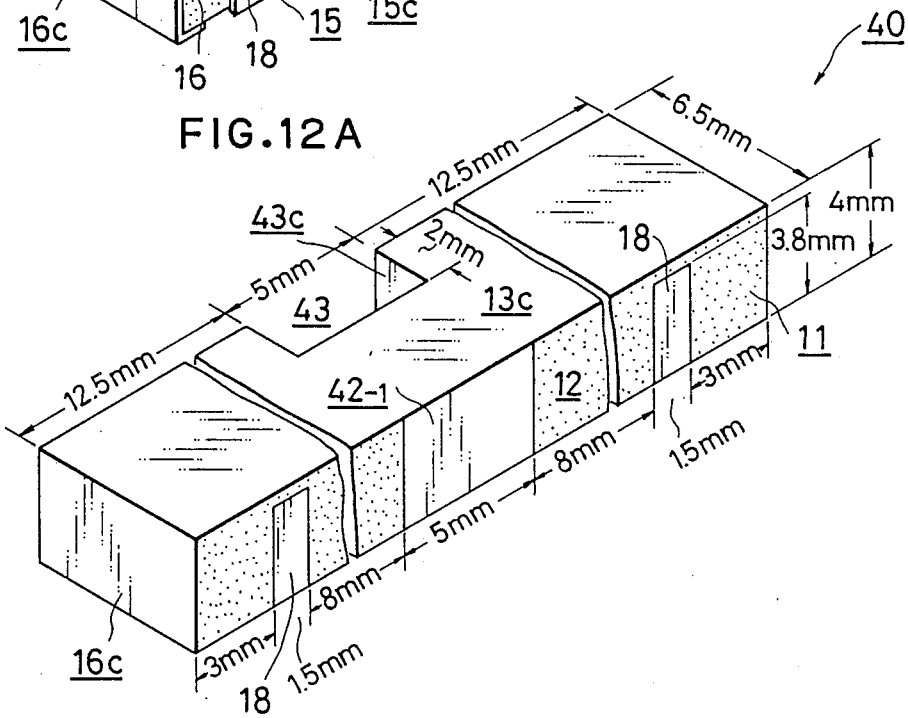
FIG. 12A is a perspective view of an embodiment of the invention in which a recess is provided in the side surface parallel to the open surface, shown together with specific dimensions.
Figure 12B:
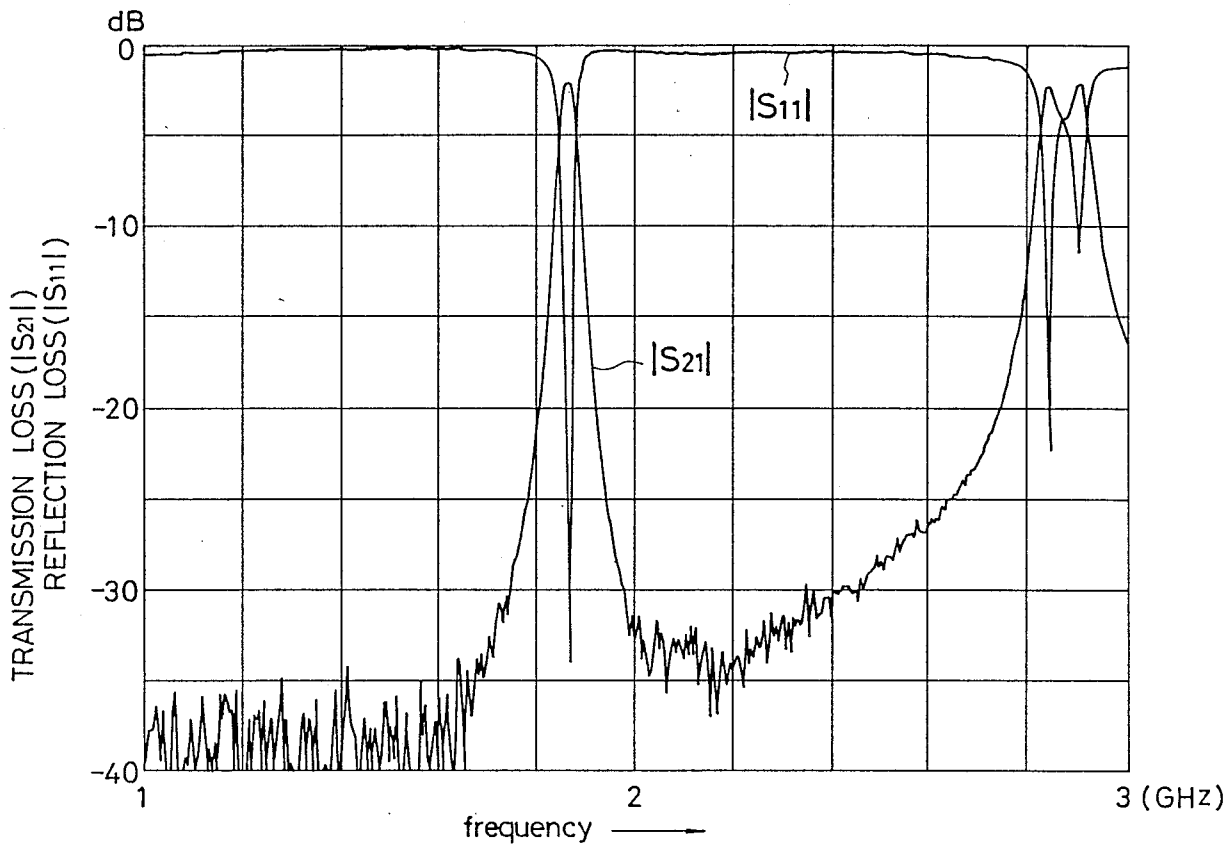
FIG. 12B is a graph showing the band-pass characteristics of the embodiment of FIG. 12A.

The characteristics of a bandpass filter 40 according to the structure of FIG. 11 fabricated to the specific dimensions shown in FIG. 12A are shown in FIG. 12B. These characteristics clearly represent a much narrower bandwidth than that shown by the characteristics of FIG. 10C and this, plus the fact that the higher mode is pushed sufficiently toward the high frequency side, make the characteristics excellent.

Figure 12C:
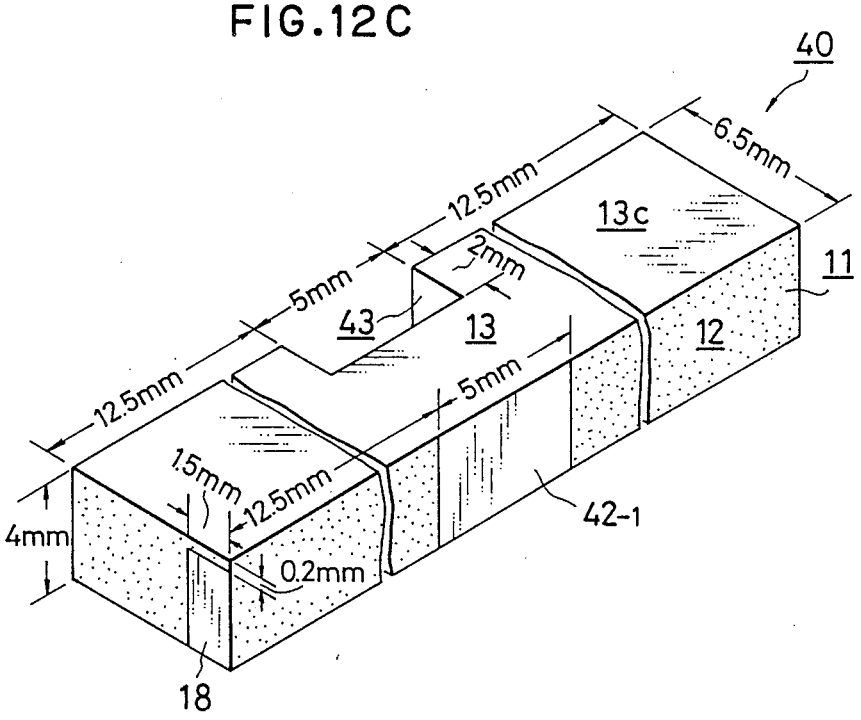
FIG. 12C is a perspective view of another embodiment of the invention in which a recess is provided in the side surface parallel to the open surface, shown together with specific dimensions.
Figure 12D:
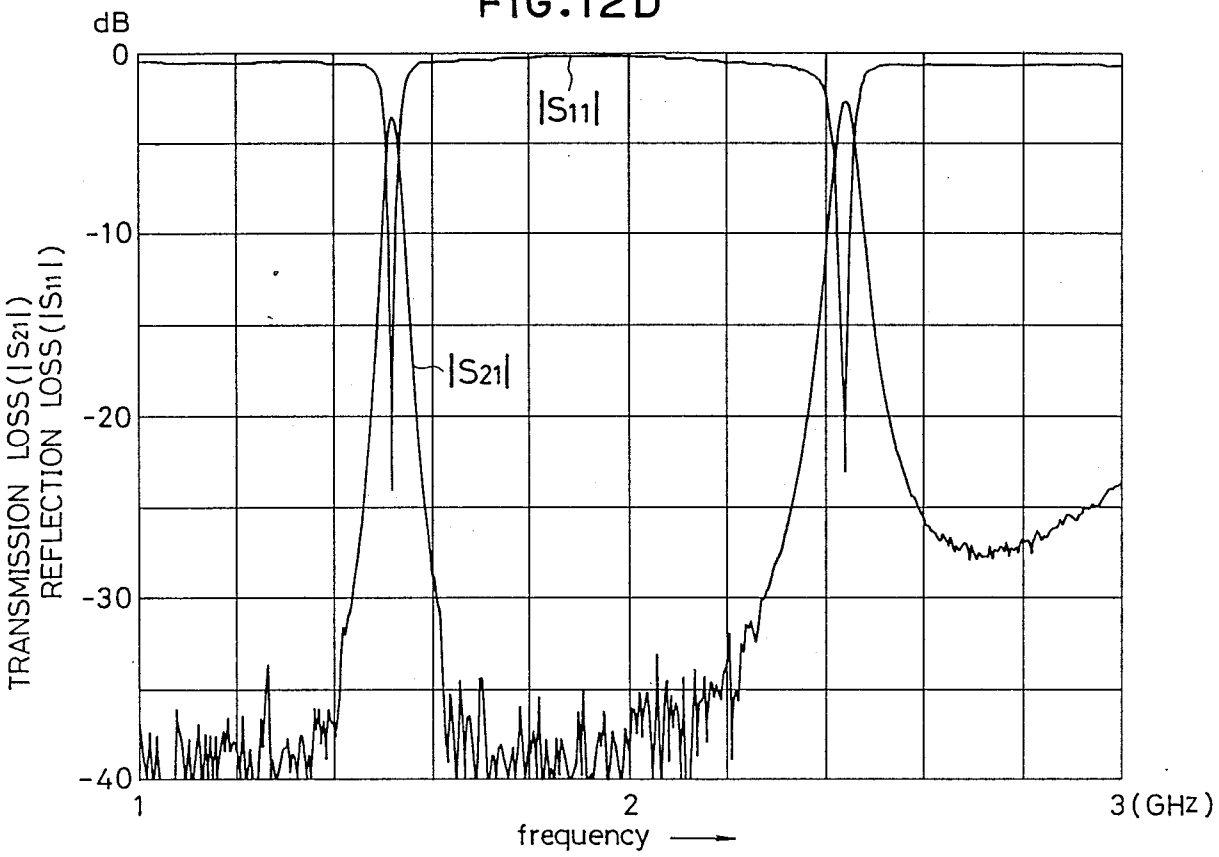
FIG. 12D is a graph showing the band-pass characteristics of the embodiment of FIG. 12C.

However, differently from the high-pass filters explained earlier, the characteristics of this bandpass filter differ depending upon whether the end surfaces 16, 17 of the dielectric block 11 are shorted or left as open surfaces. For example, if the end surfaces 16, 17 of the dielectric block 11 are both left open as shown in FIG. 12C and are applied with excitation electrodes 18, 18 of conductive pattern type as illustrated in FIGS. 1, 5A, 9A and 10A, the characteristics will be as shown in FIG. 12D, with the center frequency of the bandpass filter being shifted to a lower frequency than in the case of the characteristics of FIG. 12B. This is because in the first order approximation the bandpass filter of the structure shown in FIG. 12C is constituted of two $\lambda_g/4$ resonators coupled with each other, while the bandpass filter of the structure shown in FIG. 12A is constituted of two $\lambda_g/2$ resonators coupled with each other. It should be noted, however, that the embodiments of FIG. 12A, 12C operate in the TE mode, not the TEM mode, so that even though the structure shown in FIG. 12C uses a $\lambda_g/4$ resonator as a basic element thereof, the center frequency is not reduced to half value.

The recess 43 which serves as a coupling adjuster between two internal resonators need not be provided on the rear surface 14 but can instead be provided, for example, on the upper surface 13, and, further, in the earlier described embodiment employing inductive post type resonators, it is possible to provide such a recess 43 in the portion between the inductive posts for adjustment of the resonant frequency and other electrical characteristics. In these cases, a similar adjusting effect can also be obtained by forming the recess 43 as an indentation at a prescribed region of the open surface.

The concept of the recess 43 can even be applied in a case where, as in FIG. 1, no significant conductive pattern is formed on the open surface 12 of the dielectric block. In this case, the recess 43 substantially couples two resonators located one on either side thereof, and as a result, instead of the high-pass filter characteristics based on the structure of FIG. 1, there is obtained a bandpass filter.

Figure 13A:
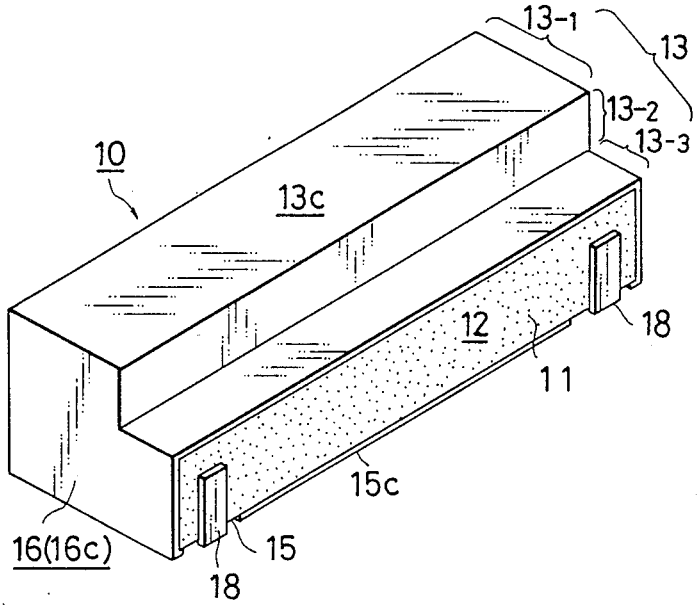
FIG. 13A is a perspective view of an embodiment of the invention which has a step provided in a side surface lying perpendicular to the open surface and exhibits high-pass characteristics.
Figure 13B:
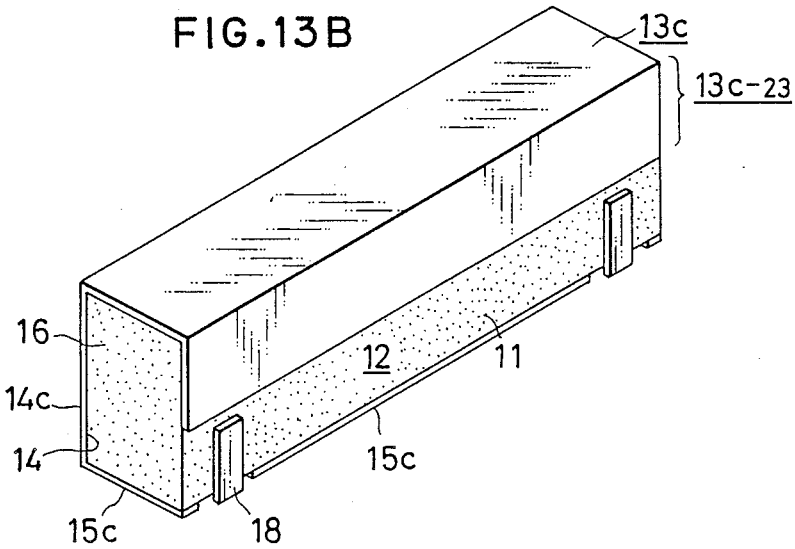
FIG. 13B is a perspective view of another embodiment of the invention which has conductive patterns, narrow in the axial direction, extending along one of the opposite edges of the open surface in the direction of the height thereof and which exhibits high-pass characteristics.

FIGS. 13A and 13B show still further embodiments of the filter according to the present invention. As regards the generally known hollow waveguide structure, there has been known a ridge-type waveguide having a recess extending along the direction of propagation of the electromagnetic waves and in parallel with the center axis of the waveguide.

Based on the concept of taking a structure corresponding to such a ridge-type waveguide, filling it with dielectric material and then in the manner of FIGS. 3 and 4, bisecting this structure along the E plane including the center axis of the waveguide in accordance with this invention, there is obtained a high-pass filter 10, as shown in FIG. 13A, which is another embodiment of this invention.

More specifically, the dielectric block 11 is formed in stair-like structure such that its upper surface 13 is formed as a lower step surface $13_{-3}$ and an upper step surface $13_{-1}$ which are connected in the vertical direction by a vertical wall portion $13_{-2}$, these three regions being coated throughout with a conductive layer 13c.

Further, in the embodiment illustrated in FIG. 13B, the portion corresponding to the lower step surface $13_{-3}$ in the embodiment of FIG. 13A is formed to extend integrally with the vertical wall portion $13_{-2}$, whereby the result is an arrangement in which the upper part of the open surface 12 of the dielectric block 11 is covered by a portion $13_{c-23}$ of the conductive layer 13c. It should be noted, however, that in the case of the structure illustrated in FIG. 13B, similar characteristics to those of the embodiment of FIG. 13A can be obtained even when the vertical length of the conductive layer portion $13_{c-23}$ covering the upper portion of the open surface over its entire axial length is considerably less than the sum of the vertical height of the conductive layer formed on the surface $13_{-2}$ in the embodiment of FIG. 13A and the width of the conductive layer formed on the surface $13_{-3}$ in the same embodiment.

These arrangements make it possible to lower the cut-off frequency even further and also enable a further reduction in the amount of electromagnetic radiation from the open surface. They also promote size reduction since the width of the filter can be made narrower. Either of these structures may, of course, be used together with the bandpass filter structure described earlier. While the end surfaces 16, 16 are shown to be shorted in FIG. 13A and open in FIG. 13B, it is, as explained above, possible to realize a filter according to the present invention with either arrangement.

Figure 14:
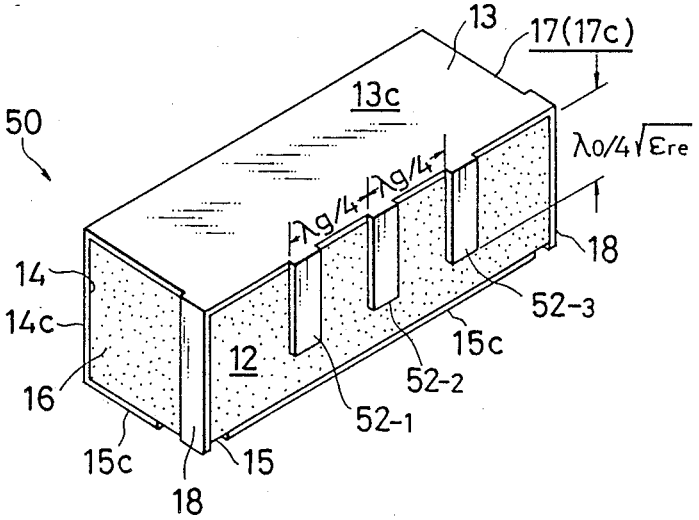
FIG. 14 is a perspective view of an embodiment of the invention constituted to exhibit band-rejection characteristics.

FIG. 14 shows a band-rejection filter 50 which is an embodiment of the present invention.

The difference between this embodiment and those described so far is simply in the configuration and manner of disposition of the conductive patterns $52_{-i}$ (i=1, 2, on the open surface of the dielectric block 11.

Therefore, elements which are the same as or similar to those of the earlier embodiments are assigned like symbols and will not be explained again here. Concentrating then on the characterizing features of this embodiment, the open surface 12 of the dielectric block 11 is provided with (in this case) three so-called open-ended conductive patterns $52_{-i}$ which respectively essentially constitute $\lambda/4$ resonators and which are spaced at intervals of one-quarter of the waveguide wavelength $\lambda_g$. These conductive patterns $52_{-i}$ are in electrical contact only at their upper ends with the conductive layer 13c on the upper surface of the dielectric block 11 and their lower ends are left open (are separated from the lower surface conductive layer 15c by an insulation region).

The length of each conductive pattern $52_{-i}$ is $$\text{The length of each conductive pattern } 52_{-i} \text{ is } \lambda_o/\sqrt{\epsilon_{re}}$$

while the relative dielectric constant $\epsilon_{re}$ can be expressed as $$\epsilon_{re}=(1-q)+q\cdot\epsilon_r;\ 0\leqq 1\leqq 1$$

While setting the interval between the adjacent conductive patterns $52_{-1}$, $52_{-2}$ and $52_{-2}$, $52_{-3}$ at one-quarter of the waveguide wavelength in the illustrated manner holds the overall length to the minimum, it is alternatively possible to set these intervals at an odd multiple of $\lambda_g/4$. Moreover, the various techniques for adjusting the coupling between adjacent resonator portions that were explained in the foregoing can also be applied to the band-rejection filter 50. As regards the excitation electrodes 18, 18, these may also be provided by any of the other patterning or attachment methods disclosed in this specification.

Figure 15:
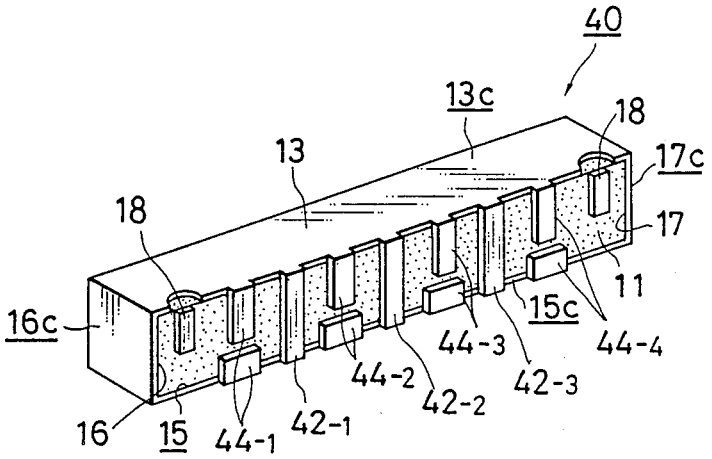
FIG. 15 is a perspective view of an embodiment having a plurality of re-entrant-type oscillator structures constituted according to the present invention.

The embodiment of FIG. 15 is the result of the application of this invention to the conventional reentrant type resonator. In this embodiment, the open surface of the dielectric block 11 is provided in the vicinity of its opposite ends with the excitation electrodes 18, 18. In this case, since connection is to be made from the side of the upper surface 13, the conductive layer 13c formed on the upper surface 13 is furnished with semicircular notches for providing insulation regions around the excitation electrodes 18, 18. However, as has been repeatedly stated, the configuration and the method of attachment of the excitation electrodes 18, 18 serving as an input terminal and an output terminal for electromagnetic wave signals can be freely selected from among the other configurations and methods described elsewhere in this specification.

What characterizes this embodiment is that conductive patterns $44_{-i}$ (i=1, 2, ....) each constituting a re-entrant type resonator and conductive patterns $42_{-i}$ (i =1, 2, ....) for adjusting the degree of coupling between these resonators are formed on the open surface 12 of the dielectric block alternately and at appropriate intervals in the axial direction. While both types of conductive patterns are in electrical contact at their upper ends with the conductive layer 13c on the upper surface of the dielectric block and in electrical contact at their lower ends with the conductive layer 15c on the bottom surface of the dielectric block, the conductive patterns $44_{-i}$ for forming the re-entrant type resonators have a vertically discontinuous portion midway thereof at which a capacitive component is formed.

This arrangement provides a bandpass filter, specifically a four-stage bandpass filter in the illustrated example, since there are four re-entrant type resonators ($44_{-1}$, $44_{-2}$, $44_{-3}$, $44_{-4}$). It is of course possible to fine-adjust the characteristics of the filter by adjusting the length of the gaps at the capacitor-forming sections of the conductive patterns $44_{-i}$ for forming the reentrant type resonators.

Figure 16:
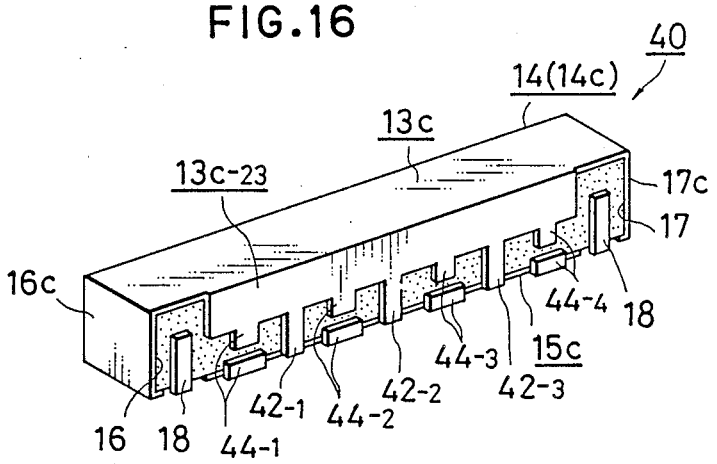
FIG. 16 is a perspective view of an embodiment of the invention realized by modifying the embodiment of FIG. 15.

By applying the structure of the embodiment according to FIG. 13B to the embodiment of FIG. 15, there can be obtained the embodiment shown in FIG. 16. More specifically, if a conductive layer $13c_{-23}$ of appropriate height is provided to extend in the axial direction or length direction along the upper edge of the open surface 12 of the dielectric block 11, it becomes possible not only to lower the cut-off frequency and otherwise adjust the electrical characteristics but also to suppress the degree of electric field leakage and thus reduce the propagation loss. A reduction of propagation loss leads to an improvement in the resonance sharpness Q.

Figure 17:
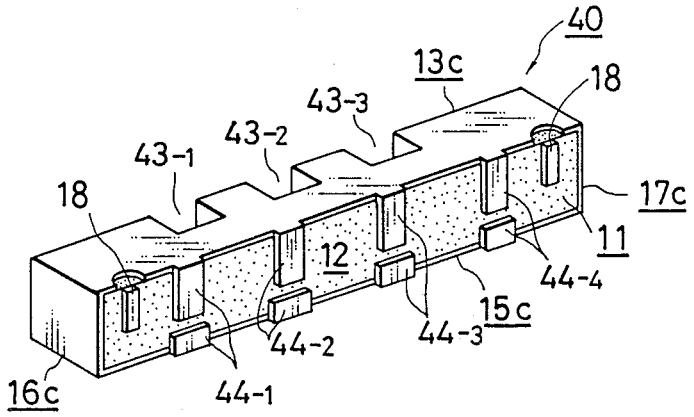
FIG. 17 is a perspective view of an embodiment of the invention with a composite structure including both recesses provided in the side surface parallel to the open surface and re-entrant-type oscillators structures.

As regards other similar combinations of the embodiments, the recess 43 seen in the embodiments of FIGS. 11, 12A, 12C can be combined with the embodiment of FIG. 15 to obtain the embodiment shown in FIG. 17. What this would amount to is replacing the conductive patterns $42_{-i}$ provided in the embodiment of FIG. 15 for adjusting the degree of coupling between the resonators with recesses $43_{-1}$, $43_{-2}$, $43_{-3}$, $43_{-4}$ and thus changing the waveguide width at these portions so as to adjust the degree of coupling between the re-entrant type resonators $44_{-1}$, $44_{-2}$, $44_{-3}$, $44_{-4}$ formed in the width direction of the waveguide at positions between the recesses. It is thus further possible in accordance with the invention to realize an embodiment which combines the features of the embodiments of FIG. 16 and 17.

Figure 18:
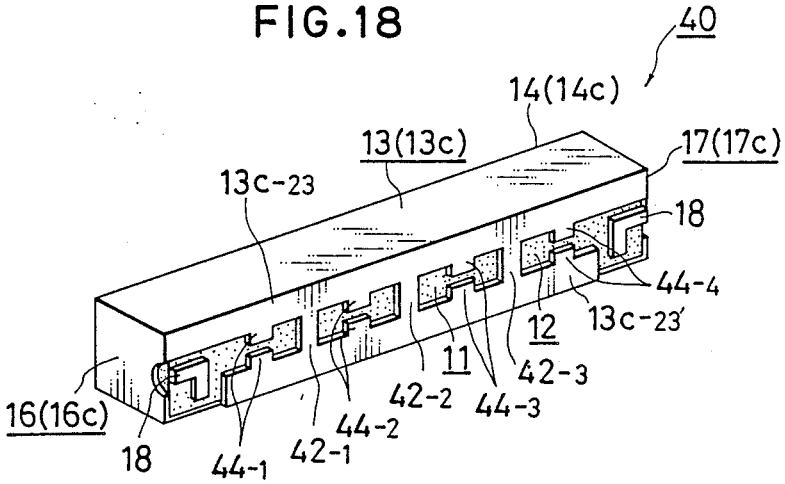
FIG. 18 is a perspective view of an embodiment of the invention in which a conductor pattern is formed on the open surface of the dielectric block in such manner as to leave dumbbell-shaped regions of the dielectric surface exposed.

The embodiment shown in FIG. 18 can be interpreted as one that is provided not only with a conductive pattern $13c_{-23}$ which, like that of the embodiment of FIG. 16, extends across the upper edge of the open surface 12 of the dielectric block in the axial direction but also with a conductive pattern $13c_{-23}'$ along the lower edge of the open surface 12. However it can also be seen as corresponding to the structure that would be obtained by bisecting, in accordance with the concept of this invention, a printed E plane circuit structure of the known type commonly employed in the millimeter wavelength band along the E plane passing through its center axis, wherein the conductive patterns $44_{-i}$ which leave the dielectric block exposed in dumbbell-like patterns each constitutes a resonator and the conductive patterns $42_{-i}$ function to adjust the degree of coupling between these resonators in the manner explained earlier.

Further, in this embodiment the excitation electrodes 18, 18 formed in the vicinity of the opposite axial ends of the open surface 12 of the dielectric block are in the shape of L's lying sideways and electrical contact with an exterior circuit is obtained from the direction of the opposite end surfaces 16, 17. For this reason a portion of the conducting material of the end surface conductive layers 16c, 17c is removed in the vicinity of the excitation electrodes so as to prevent them from shorting. The embodiments described heretofore can also be applied to the arrangement just described. Further, as was suggested earlier, in the embodiments of FIGS. 15 to 18, too, it is possible to selectively provide or not provide the axial end surfaces 16, 17 of the dielectric block 11 with conductive layers 16c, 17c, whereby there can be obtained different characteristics accordingly.

As will be understood from the several embodiments described in detail herein, the present invention is highly efficient irrespective of whether it is applied for obtaining a high-pass filter, a bandpass filter or a band-rejection filter since the type of filter to be obtained and the actual characteristics thereof in each case depend on the configuration of conductive layers formed by patterning on the open face of a dielectric block. This type of patterning can be conducted with utmost ease and with high precision and reproducibility. Moreover, the filter according to the present invention is compact.

Further, since the conductive layers are formed so as to be accessible from the exterior, they can be easily modified after fabrication by removal of required amounts thereof as necessary for fineadjustment of the characteristics. This is in contrast to the conventional dielectric filters which have their conductive layers located in the interior of the dielectric block, making it is impossible, or at least extremely difficult, to use a method of adjustment that involves physical removal or the like of the conductive layers.

Also, while some of the embodiments of the invention require the provision of recesses, slits, steps or the like in the dielectric block, whose basic form is a bar of rectangular cross section, these can be easily formed in comparison with the case of providing such special geometrical configurations in the interior of a dielectric block, and can, after they are formed, be simply modified by grinding or other type of mechanical machining for adjustment.

In the dielectric waveguide-type filter of this invention it is in principle necessary to apply conductive layers over the whole area of the three side surfaces 13, 14, 15 of the dielectric block leaving only the side surface 12 open. However, it is permissible for fine-adjustment of the characteristics (e.g. for fine-adjustment of the resonant frequency of a resonator) for one or more of the three side surfaces 13, 14, 15 to have a small area region which is not formed with the conductive layer or which has been removed of its conductive layer. Thus the requirement is for a major portion of at least said three side surfaces to have conductive layers over the major part of the area thereof. In contrast, as was explained earlier, the axial end surfaces are not required to have conductive layers, and in some case the presence or absence has no effect on the characteristics while in others, such as where a bandpass filter or a band-rejection filter is constituted according to the invention, the provision or not of end surface conductive layers can be selectively decided based on design consideration for modifying the characteristics as desired.

The present invention has thus been shown and described with reference to specific embodiments. However, it should be noted that the present invention is in no way limited to the details of the described arrangements but changes and modifications may be made without departing from the scope of the appended claims.

What is claimed is:

1. A dielectric waveguide-type filter comprising a dielectric block that is long in an axial direction lying perpendicular to its width and height, conductive layers provided on three of four surfaces extending in the lengthwise direction of said dielectric block, the fourth surface being left as an open surface, and a pair of electrode patterns formed by patterning of conductive material on the dielectric block, one of said patterns serving as an input terminal for microwaves and the other thereof serving as an output terminal for microwaves, whereby high-pass characteristics are obtained between the pair of electrode patterns.

2. A dielectric waveguide-type filter according to claim 1 wherein one of said four side surfaces which lies perpendicular to the open surface has a step in the height direction.

3. A dielectric waveguide-type filter according to claim 1 further comprising a narrow conductive pattern portion formed to extend in the axial direction with a height of prescribed magnitude along one edge of the two edges in the height direction of the open surface of the dielectric block and to make electrical contact with the conductive layer formed on the side surface which lies perpendicular to the open surface and connects therewith at said one edge.

4. A dielectric waveguide-type filter according to any of claims 1, 2 and 3 further comprising a conductive layer formed on each of the end surfaces in said axial direction of the dielectric block to make electrical contact with the conductive layers formed on said three side surfaces.

5. A dielectric waveguide-type filter in accordance with any of claims 1, 2 and 3 wherein the end surfaces in said axial direction of the dielectric block are left open.

6. A dielectric waveguide-type filter comprising a dielectric block that is long in an axial direction lying perpendicular to its width and height, conductive layers provided on three of four surfaces extending in the lengthwise direction of said dielectric block, the fourth surface being left as an open surface, a pair of electrode patterns formed by patterning of conductive material on the dielectric block, one of said patterns serving as an input terminal for microwaves and the other thereof serving as an output terminal for microwaves, and a recess formed at least at one location in the axial direction of the dielectric block to reduce the cross-sectional area of the dielectric block over a prescribed length in the axial direction, whereby bandpass characteristics are obtained between the pair of electrode patterns.

7. A dielectric waveguide-type filter according to claim 6 further comprising a conductive layer formed on each of the end surfaces in said axial direction of the dielectric block to make electrical contact with the conductive layers formed on said three side surfaces.

8. A dielectric waveguide-type filter in accordance with claim 6 wherein the end surfaces in said axial direction of the dielectric block are left open.

9. A dielectric waveguide-type filter comprising, a dielectric block that is long in an axial direction lying perpendicular to its width and height, conductive layers provided on three of four surfaces extending in the lengthwise direction of said dielectric block, the fourth surface being left as an open surface, a pair of electrode patterns formed by patterning of conductive material on the dielectric block, one of said patterns serving as an input terminal for microwaves and the other thereof serving as an output terminal for microwaves, and a conductive pattern formed on the open surface of the dielectric block in a prescribed configuration and manner of disposition by patterning of conductive material, whereby prescribed filter characteristics are obtained between the pair of electrode patterns.

10. A dielectric waveguide-type filter according to claim 9 wherein the conductive pattern formed on the open surface of the dielectric block by patterning has at least one conductive pattern portion of a first configuration which makes electrical contact at its one end in the height direction with the conductive layer formed on one side surface among the two axially extending side surfaces lying perpendicular to the open surface, makes electrical contact at its other end in the height direction with the conductive layer formed on the other side surface among said two side surfaces, and by having a prescribed length in the axial direction has the overall shape of a strip, whereby bandpass characteristics are obtained between the pair of electrode patterns.

11. A dielectric waveguide-type filter according to claim 10 further comprising a recess formed at an axial position of the conductive pattern portion of the first configuration formed by patterning on the open surface of the dielectric block, said recess reducing the cross-sectional area of the dielectric block.

12. A dielectric waveguide-type filter according to claim 10 wherein the number of the conductive pattern portions of the first configuration formed by patterning on the open surface of the dielectric block is at least two and the at least two conductive pattern portions are spaced from each other in the axial direction.

13. A dielectric waveguide-type filter according to claim 12 further comprising recesses formed one at the axial position of each of the at least two conductive pattern portions of the first configuration formed as spaced in the axial direction by patterning on the open surface of the dielectric block, said recesses reducing the cross-sectional area of the dielectric block.

14. A dielectric waveguide-type filter according to claim 9 wherein the conductive pattern formed on the open surface of the dielectric block by patterning has at least one conductive pattern portion of a second configuration which makes electrical contact at its one end in the height direction with the conductive layer formed on one side surface among the two axially extending side surfaces lying perpendicular to the open surface, makes electrical contact at its other end in the height direction with the conductive layer formed on the other side surface among said two side surfaces, and has a discontinuous portion midway thereof for producing a capacitive component, whereby bandpass characteristics are obtained between the pair of electrode patterns.

15. A dielectric waveguide-type filter according to claim 14 wherein the number of the conductive pattern portions of the second configuration formed by patterning on the open surface of the dielectric block is at least two and the at least two conductive pattern portions are spaced from each other in the axial direction.

16. A dielectric waveguide-type filter according to claim 15 further comprising recesses formed one at an axial position between each adjacent pair of the at least two conductive pattern portions of the second configuration formed as spaced in the axial direction by patterning on the open surface of the dielectric block, said recesses reducing the cross-sectional area of the dielectric block.

17. A dielectric waveguide-type filter according to claim 9 having at least one conductive pattern portion of a first configuration which makes electrical contact at its one end in the height direction with the conductive layer formed on one side surface among the two axially extending side surfaces lying perpendicular to the open surface, makes electrical contact at its other end in the height direction with the conductive layer formed on the other side surface among said two side surfaces, and by having a prescribed length in the axial direction has the overall shape of a strip, and at least one conductive pattern portion of a second configuration which makes electrical contact at its one end in the height direction with the conductive layer formed on one side surface among the two axially extending side surfaces lying perpendicular to the open surface, makes electrical contact at its other end in the height direction with the conductive layer formed on the other side surface among said two side surfaces, and has a discontinuous portion midway thereof for producing a capacitive component, a conductive pattern portion of the first configuration being provided at an axial position between each pair of the conductive patterns portions of the second configuration, whereby bandpass characteristics are obtained between the pair of electrode patterns.

18. A dielectric waveguide-type filter in accordance with claim 17 wherein a narrow conductive pattern portion is formed to extend in the axial direction with a height of prescribed magnitude along one edge of the two edges in the height direction of the open surface of the dielectric block and to make electrical contact with the conductive layer formed on the side surface which lies perpendicular to the open surface and connects therewith at said one edge.

19. A dielectric waveguide-type filter according to claim 17 wherein two narrow conductive pattern portions are formed to extend in the axial direction with a height of prescribed magnitude one along each of the two edges in the height direction of the open surface of the dielectric block, each narrow conductive pattern portion making electrical contact with the conductive layer formed on the side surface which lies perpendicular to the open surface and connects therewith at said one edge.

20. A dielectric waveguide-type filter according to claim 9 wherein the conductive pattern formed on the open surface of the dielectric block by patterning has at least one conductive pattern portion of a third configuration which measures one-quarter wavelength in its height direction and has a short length in said axial direction, makes electrical contact at its one end in the height direction with the conductive layer formed on one side surface among the two axially extending side surfaces lying perpendicular to the open surface, and is electrically open at its other end in the height direction, whereby band-rejection characteristics are obtained between the pair of electrode patterns.

21. A dielectric waveguide-type filter according to claim 20 wherein the number of the conductive pattern portions of the third configuration formed by patterning on the open surface of the dielectric block is at least two and the distance in the axial direction between adjacent ones of the at least two conductive pattern portions of the third configuration is an odd multiple of said one-quarter wavelength.

22. A dielectric waveguide-type filter according to any of claims 9 to 21 further comprising a conductive layer formed on each of the end surfaces in said axial direction of the dielectric block to make electrical contact with the conductive layers formed on said three side surfaces.

23. A dielectric waveguide-type filter according to any of claims 9 to 21 wherein the end surfaces in said axial direction of the dielectric block are left open.

* * * * *